US007057577B1

(12) United States Patent
Willoughby et al.

(10) Patent No.: US 7,057,577 B1
(45) Date of Patent: Jun. 6, 2006

(54) ANTENNA CONNECTOR FOR HAZARDOUS AREA

(75) Inventors: Chris Willoughby, Loveland, OH (US); Gregg Popp, Lebanon, OH (US); Mark Peters, Hamilton, OH (US)

(73) Assignee: Ventek LLC, West Chester, OH (US)

( * ) Notice: Subject to any disclaimer, the term of this patent is extended or adjusted under 35 U.S.C. 154(b) by 218 days.

(21) Appl. No.: 10/845,280

(22) Filed: May 13, 2004

(51) Int. Cl.
*H01Q 1/50* (2006.01)

(52) U.S. Cl. ..... 343/906; 343/872; 343/905

(58) Field of Classification Search ..... 43/830, 43/872, 905, 906
See application file for complete search history.

(56) References Cited

U.S. PATENT DOCUMENTS

| | | | | |
|---|---|---|---|---|
| 6,980,174 | B1 * | 12/2005 | Flasza et al. | 343/850 |
| 2004/0113635 | A1 * | 6/2004 | Masuda et al. | 324/672 |
| 2004/0183744 | A1 * | 9/2004 | Raiman | 343/906 |
| 2004/0194994 | A1 * | 10/2004 | Rasmussen | 174/76 |

* cited by examiner

*Primary Examiner*—Shih-Chao Chen
(74) *Attorney, Agent, or Firm*—Camoriano and Associates; Theresa Fritz Camoriano

(57) ABSTRACT

A device for connecting an antenna to a hazardous enclosure. The device includes an intrinsically safe barrier for protection against electrical surges, and an explosion-proof device enclosure to contain the force of an explosion.

19 Claims, 1 Drawing Sheet

ANTENNA CONNECTOR FOR HAZARDOUS AREA

BACKGROUND OF THE INVENTION

The present invention relates to a fitting for connecting an antenna. More particularly, it relates to a fitting for connecting an antenna in a hazardous area environment to an electrical enclosure such as an explosion-proof enclosure, a safe area enclosure, or to an electrical conduit.

The length of an antenna depends on the frequency of the transmitted signal. Therefore, for different frequencies of transmission, and for different radio receivers and transmitters, it may be necessary to have different length antennas. Standards for installation of electrical equipment in hazardous area environments require that the installation comply with two types of protection:

an intrinsically safe barrier which will suppress an electrical surge which may potentially travel through the device, and an explosion-proof device enclosure to withstand the maximum anticipated force of an explosion.

Prior art methods for complying with these standards as they relate to antennas include the use of a capacitive block circuit inside the explosion-proof or safe area enclosure to provide the intrinsically safe barrier, and/or an antenna which has been completely encased in a hazardous area sealing compound. This encased antenna is intended to be mounted directly to the electrical enclosure. If the electrical enclosure is not immediately adjacent to the antenna, and is instead separated from the enclosure by a conduit, then sealing fittings are required both where the antenna mounts to the conduit and where the conduit connects to the enclosure. The installation of sealing fittings is expensive, labor intensive, and time consuming (the sealing compound must be allowed to cure after it is injected into the sealing fitting).

This prior art method is highly inflexible. If the encased antenna was incorrectly specified or supplied, or if the receiver or transmitter must be replaced with one of different frequency, or if the encased antenna is accidentally damaged, there is no simple manner to replace the antenna. The entire encased antenna (and any sealing fittings installed adjacent to the antenna) must be replaced. This is expensive and time consuming.

SUMMARY OF THE INVENTION

The present invention provides an intrinsically safe, explosion-proof antenna fitting which may be threaded directly into an explosion-proof enclosure, a safe area enclosure, or an electrical conduit, without the need for further sealing fittings required at the connection point with the antenna fitting. A standard antenna may then be connected to the receptacle projecting from the antenna fitting. Should the antenna become damaged or in need of replacement, it is a simple, inexpensive, and quick matter to unscrew the old standard antenna and replace it with a new one or one of the correct length.

In a preferred embodiment, the antenna fitting is made of a corrosion resistant grade of stainless steel, threaded at one end for screwing into the enclosure or conduit. The antenna fitting defines a hollow cavity. Inside this cavity, a circuit board with a capacitive block circuit provides the intrinsically safe barrier. The cavity is then filled with a two-part compound. The first compound is a hazardous area sealing compound to withstand the expected force of an explosion. The second compound is an electrical potting compound which surrounds the capacitive block circuit and serves as an electrical insulator, protects the components from moisture, and provides strain relief for the coaxial cable projecting from a first end of the fitting. This coaxial cable connects to a radio transmitter or a receiver. Projecting from a second end of the fitting is a standard, reverse polarity SMA receptacle antenna connector to which a standard antenna may be easily and readily connected.

In a preferred embodiment, the circuit board components have a dielectric rating of 1500 volts and the capacitive block circuit prevents fault condition pass-through of alternating or direct current up to 250 volts. The circuit board components also provide a second function as they provide a means for optional radio attenuation if the radio transmits at too high a power level. This option can be jumpered out if the radio is internally attenuated.

In a preferred embodiment, the antenna fitting is designed to withstand a 6,000 PSIG hydraulic pressure test. Thus, the antenna fitting and the hazardous area sealing compound within the antenna fitting are designed to withstand the force of an explosion, eliminating the need for a separate potted sealing fitting at the point where the antenna fitting connects to the electrical conduit or to the electrical enclosure.

DESCRIPTION OF THE PREFERRED EMBODIMENT

Figure 1:
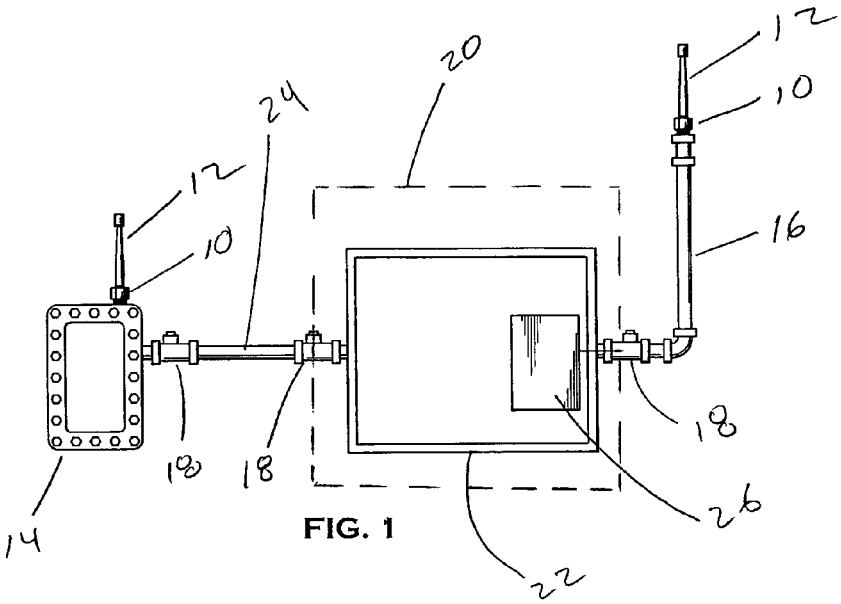
FIG. 1 is a schematic view of a typical application of an antenna fitting made in accordance with the present invention.
Figure 2:
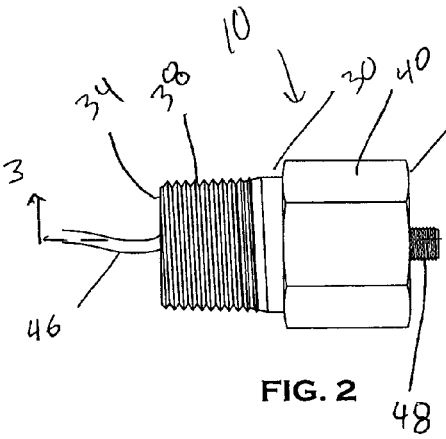
FIG. 2 is a plan view of an antenna fitting made in accordance with the present invention.
Figure 3:
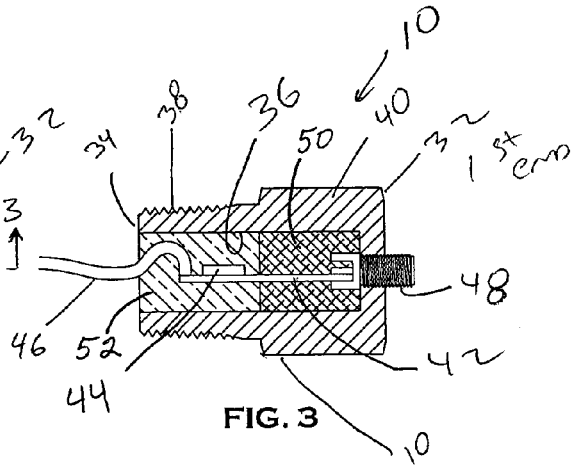
FIG. 3 is a sectional view along line 3—3 of FIG. 2.
Figure 4:
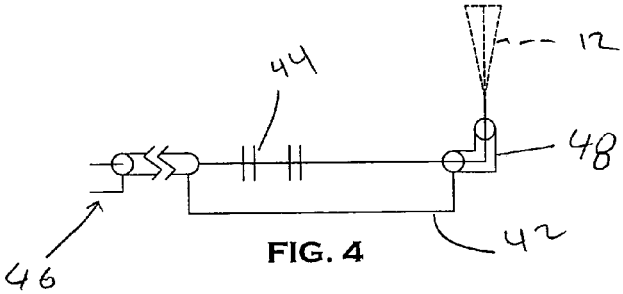
FIG. 4 is a schematic of the electrical circuit, including the capacitive block circuit, of the antenna fitting of FIGS. 2 and 3.

FIGS. 1–3 show an antenna fitting 10 for connecting an antenna 12 to an electrical enclosure 14 or to an electrical conduit 16. As discussed in more detail below, FIG. 3 shows a more detailed view of the antenna fitting 10 made in accordance with the present invention.

Referring now to FIG. 1, the area inside the dotted rectangle 20 represents an electrically safe area classification environment, while the area outside of the dotted rectangle represents an electrically hazardous area classification environment. Thus, the electrical enclosure 22 inside the safe area environment may be a conventional electrical enclosure, while the enclosure 14 is an explosion-proof enclosure 14 for use in an electrically hazardous area classification environment. As may be appreciated from this schematic, a standard antenna 12 may be mounted directly to the enclosure 14 via the antenna fitting 10 without the need for additional potted fittings such as the potted fittings 18 shown elsewhere in FIG. 1.

Potted fittings 18 are placed at both ends of the conduit 24 connecting the explosion proof enclosure 14 to the safe area enclosure 22 to make sure that no hazardous-area environment may travel through the conduit 24 either into the explosion proof enclosure 14 or into the safe area enclosure 22.

On the right hand side of FIG. 1, an antenna 12 is mounted to a conduit 16 via an antenna fitting 10. This mounting arrangement may be useful, for instance, to obtain a more advantageous vantage point for sending (or broadcasting)

signals to (from) the antenna 12. A potted fitting 18 is once again used at one end of the conduit 16 to ensure that no hazardous-area environment may travel through the conduit 16 into the safe area enclosure 22. However, a separate potted fitting 18 is not required at the other end of the conduit 16 which connects to the antenna 12, because the antenna fitting 10 fulfills this requirement.

It may also be appreciated that the antenna 12 is connected directly to a radio unit 26 inside the enclosure 22 via the antenna fitting 10, without first going through a separate capacitive block circuit inside the explosion-proof enclosure 14 or safe area enclosure 22 to provide the required intrinsically safe barrier. This is because, as described in more detail later, the antenna fitting 10 includes a circuit board 42 with a capacitive block circuit 44 which provides the intrinsically safe barrier to suppress an electrical surge which may potentially travel through the device.

Referring to FIGS. 2 and 3, the antenna fitting 10 is substantially cylindrical and includes a housing 30, defining a first end 32, a second end 34, and a hollow cavity 36 between the first and second ends 32, 34. The housing 30 includes an externally threaded portion 38 adjacent the second end 34 and an integrally formed nut 40 adjacent the first end 32.

An electrical circuit 42, which includes a capacitive block circuit 44, is housed inside the cavity 36 of the housing 30. This electrical circuit 42 is in electrical continuity with an electrical conductor such as a coaxial cable 46, which projects beyond the second end 34 of the housing 30, and which may be used to connect directly to the radio unit 26. This electrical circuit 42 is also in electrical continuity with a threaded RPSMA receptacle connector 48, which projects beyond the first end 32 of the housing 30. A standard antenna 12 may be readily screwed onto the RPSMA receptacle connector 48.

Once the electrical circuit 42 is placed inside the cavity 36 of the housing 30, a first sealing compound 50, which is a hazardous area sealing compound, is added to the cavity 36 to encapsulate at least a portion of the electrical circuit 42 and hold it within the housing 30. A second sealing compound 52, which is an electrical potting compound, is then added to finish encapsulating the electrical circuit 42. This electrical potting compound 52 serves as an electrical insulator, protects the components from moisture, and provides strain relief for the coaxial cable 46 projecting from the second end 34 of the antenna fitting 10.

While the embodiment described above shows an antenna fitting 10 for use in a typical "standard" application, various modifications could be made. For instance, the integrally formed nut 40 could be substituted by some other means for tightening the antenna fitting 10 onto the enclosure or conduit. The two-part sealing compound could be substituted by a three (or more) part sealing compound, or even by a single part sealing compound which provides both the structural integrity to resist the force of an explosion and provides the required electrical insulation characteristics. The standard, threaded RPSMA receptacle connector may be substituted by any other connector which meets the functional requirements of the antenna 12 which is to be coupled to the antenna fitting 10. It will be obvious to those skilled in the art that other modifications may be made to the embodiments described above without departing from the scope of the present invention.

What is claimed is:

1. A fitting for connecting an antenna, comprising:

a housing defining first and second ends;

a hollow cavity between said first and second ends;

an antenna receptacle at said first end;

an electrical conductor at said second end;

a capacitive block circuit in said hollow cavity in electrical continuity with said antenna receptacle and with said conductor; and at least one sealing compound encasing at least a portion of said capacitive block circuit inside said hollow cavity.

2. A fitting for connecting an antenna as recited in claim 1, wherein said conductor is a coaxial cable.

3. A fitting for connecting an antenna as recited in claim 1, wherein said antenna receptacle has external threads and projects from said first end.

4. A fitting for connecting an antenna as recited in claim 1, wherein said sealing compound is a hazardous area sealing compound.

5. A fitting for connecting an antenna as recited in claim 4, and further comprising a second sealing compound inside said hollow cavity, wherein said second sealing compound is an electrical potting compound.

6. A fitting for connecting an antenna as recited in claim 5, wherein said second sealing compound encases at least a portion of said capacitive block circuit.

7. A fitting for connecting an antenna as recited in claim 6, wherein said housing further defines an externally threaded portion adjacent said second end, and an integrally formed nut adjacent said first end.

8. A fitting for connecting an antenna as recited in claim 7, wherein said housing is made from a corrosion resistant grade of stainless steel.

9. A fitting for connecting an antenna as recited in claim 6, and further comprising a circuit board, which includes said capacitive block circuit, wherein said circuit board is inside said cavity.

10. A hazardous area enclosure, comprising:

an enclosure wall defining a safe area on one side of said wall and a hazardous area the other side of said wall, said wall further defining a threaded opening through said wall;

a fitting for an antenna, including a single piece housing defining a first end; a second end which is externally threaded; a hollow cavity between said first and second ends; an antenna receptacle at said first end; and an electrical conductor at said second end, wherein said threaded second end of said housing is received in said threaded opening in said wall;

a capacitive block circuit in said hollow cavity, in electrical continuity with said antenna receptacle and with said conductor; and at least one sealing compound encasing at least a portion of said capacitive block circuit inside said hollow cavity.

11. A hazardous area enclosure as recited in claim 10, and further comprising an antenna mounted to said antenna receptacle.

12. A hazardous area enclosure as recited in claim 11, wherein said antenna receptacle has external threads and projects from said first end.

13. A hazardous area enclosure as recited in claim 10, wherein said sealing compound is a hazardous area sealing compound.

14. A hazardous area enclosure as recited in claim 13, and further comprising a second sealing compound in said hollow cavity, wherein said second sealing compound is an electrical potting compound.

15. A hazardous area enclosure as recited in claim 14, wherein said second sealing compound encases at least a portion of said capacitive block circuit.

16. A hazardous area enclosure as recited in claim 15, wherein said housing further defines an integrally formed nut adjacent said first end.

17. A hazardous area enclosure as recited in claim 15, wherein said housing is made from a corrosion resistant grade of stainless steel.

18. A hazardous area enclosure as recited in claim 15, and further comprising a circuit board which includes said capacitive block circuit, wherein said circuit board is inside said cavity.

19. A hazardous area enclosure, comprising:

an enclosure wall defining a safe area on one side of said wall and a hazardous area the other side of said wall, said wall further defining a threaded opening through said wall;

a sealing fitting including a first sealing fitting end threaded into said threaded opening at said enclosure wall, and a second sealing fitting end;

a conduit defining a first and second conduit ends, said first conduit end being secured to said second sealing fitting end;

a one-piece housing defining a first housing end, a second, externally threaded housing end; a hollow cavity between said first and second housing ends; an antenna receptacle at said first housing end; and an electrical conductor at said second housing end; wherein said threaded second housing end is received in said second conduit end;

a capacitive block circuit in said hollow cavity, in electrical continuity with said antenna receptacle and with said conductor;

at least one sealing compound encasing at least a portion of said capacitive block circuit inside said hollow cavity; and an antenna mounted to said antenna receptacle.

* * * * *